US009163402B2

(12) United States Patent
Kabatsi et al.

(10) Patent No.: US 9,163,402 B2
(45) Date of Patent: Oct. 20, 2015

(54) SUSPENDED ARCHITECTURAL STRUCTURE

(71) Applicant: ARKTURA LLC, Gardena, CA (US)

(72) Inventors: Chris Kabatsi, Gardena, CA (US); Robert Kilian, Gardena, CA (US)

(73) Assignee: ARKTURA LLC, Gardena, CA (US)

( * ) Notice: Subject to any disclaimer, the term of this patent is extended or adjusted under 35 U.S.C. 154(b) by 0 days.

(21) Appl. No.: 14/184,531

(22) Filed: Feb. 19, 2014

(65) Prior Publication Data

US 2014/0166836 A1 Jun. 19, 2014

Related U.S. Application Data

(63) Continuation-in-part of application No. 13/159,344, filed on Jun. 13, 2011, now Pat. No. 8,733,053.

(51) Int. Cl.

| | |
|---|---|
| ***E04B 9/00*** | (2006.01) |
| ***E04B 9/34*** | (2006.01) |
| *E04B 1/58* | (2006.01) |

(52) U.S. Cl.

CPC . *E04B 9/345* (2013.01); *E04B 9/00* (2013.01); *E04B 1/5806* (2013.01)

(58) Field of Classification Search

CPC ..... E04B 1/38; E04B 2/00; E04B 9/00; E04B 5/10; E04C 1/40; E04C 3/02; E04C 2/52

USPC ..... 52/220.6, 506.05, 647, 712, 668, 52/506.06, 506.08, 506.1, 669, 316, 222, 52/507, 506.01, 506.07; 160/131, 166.1; 248/317, 339, 343

See application file for complete search history.

(56) References Cited

U.S. PATENT DOCUMENTS

| | | | | | |
|---|---|---|---|---|---|
| 2,639,011 | A | * | 5/1953 | Peterson | 52/668 |
| 3,044,586 | A | * | 7/1962 | Cassels | 52/668 |
| 3,310,922 | A | * | 3/1967 | Hoffmann, Jr. | 52/506.06 |
| 3,417,530 | A | * | 12/1968 | Long | 52/506.08 |
| 3,755,988 | A | * | 9/1973 | Van Der Sluys | 52/473 |
| 3,768,224 | A | * | 10/1973 | Curtis | 52/668 |
| 3,835,614 | A | * | 9/1974 | Downing, Jr. | 52/666 |
| 3,911,638 | A | * | 10/1975 | Englund et al. | 52/506.08 |
| 3,918,234 | A | * | 11/1975 | Weissman | 52/39 |
| 3,969,870 | A | * | 7/1976 | Deaton | 52/645 |
| 4,034,534 | A | * | 7/1977 | Taylor | 52/668 |
| 4,133,160 | A | * | 1/1979 | Segil | 52/645 |
| 4,364,215 | A | * | 12/1982 | Gailey et al. | 52/506.08 |
| 4,426,822 | A | * | 1/1984 | Gailey | 52/669 |
| 4,485,605 | A | * | 12/1984 | LaLonde | 52/665 |
| 4,545,165 | A | * | 10/1985 | Carey et al. | 52/506.07 |
| 4,580,387 | A | * | 4/1986 | Rogers | 52/665 |
| 4,760,680 | A | * | 8/1988 | Myers | 52/669 |
| 4,783,946 | A | * | 11/1988 | Boegle | 52/506.1 |
| 4,827,687 | A | * | 5/1989 | Frawley | 52/506.06 |
| 4,866,900 | A | * | 9/1989 | Dunn | 52/506.07 |

(Continued)

*Primary Examiner* — Nkeisha Smith

(74) *Attorney, Agent, or Firm* — Cotman IP Law Group, PLC

(57) ABSTRACT

A suspended architectural structure includes a plurality of fin support members configured to couple with one or more architectural structures, e.g. ceiling structure. A plurality of flexible fins, with each flexible fin including a plurality of attachment points that is configured to be coupled to the plurality of fin support members. The plurality of fin support members includes a rib frame and a plurality of lateral rib members. The flexible fins are coupled to the ribs by the attachment points using removable pins.

14 Claims, 14 Drawing Sheets

(56) References Cited

U.S. PATENT DOCUMENTS

| | | | | | |
|---|---|---|---|---|---|
| 5,115,611 | A * | 5/1992 | Lim et al. | 52/537 |
| 5,241,799 | A * | 9/1993 | Jahn | 52/506.06 |
| 5,475,962 | A * | 12/1995 | Horsten et al. | 52/506.08 |
| 5,893,250 | A * | 4/1999 | Benvenuto et al. | 52/506.08 |
| 6,047,517 | A * | 4/2000 | Vrame | 52/506.06 |
| 6,230,464 | B1 * | 5/2001 | Vrame | 52/506.08 |
| 6,244,010 | B1 * | 6/2001 | Sluiter | 52/643 |
| 6,318,042 | B1 * | 11/2001 | Bloom et al. | 52/506.07 |
| 7,406,802 | B2 * | 8/2008 | Stackenwalt et al. | 52/222 |
| 7,428,801 | B2 * | 9/2008 | Ostenfeldt | 52/144 |
| 7,478,787 | B2 * | 1/2009 | Bankston et al. | 248/343 |
| 7,730,690 | B2 * | 6/2010 | Miller et al. | 52/506.05 |
| 8,096,089 | B2 * | 1/2012 | Platt | 52/316 |
| 8,640,408 | B2 * | 2/2014 | Wilkens | 52/220.6 |
| 2005/0011150 | A1 * | 1/2005 | Stackenwalt et al. | 52/311.1 |
| 2008/0307724 | A1 * | 12/2008 | Krantz-Lilienthal et al. | 52/222 |
| 2012/0159890 | A1 * | 6/2012 | Wilkens | 52/506.06 |
| 2013/0014461 | A1 * | 1/2013 | Belanger | 52/506.07 |
| 2015/0027075 | A1 * | 1/2015 | Wilkens et al. | 52/385 |

* cited by examiner

SUSPENDED ARCHITECTURAL STRUCTURE

CROSS-REFERENCE TO RELATED APPLICATIONS

The present application is a continuation-in-part of U.S. patent application Ser. No. 13/159,344, filed on Jun. 13, 2011, specification of which is herein incorporated by reference for completeness of disclosure.

BACKGROUND OF THE INVENTION

1. Field of the Invention

This invention relates to suspended architectural structures, and more particularly to architectural structures suspended from structural components of a ceiling system.

2. Description of Related Art

Suspended architectural structures are widely used in interior constructions for aesthetic and other reasons. Typically, suspended architectural structures include panels spaced below the true or structural ceiling of a room, and carried by horizontal members which are themselves suspended from the true ceiling.

One form of suspended architectural structure employs elongated metal components (e.g. panels) extending horizontally in spaced parallel relation to each other with their major surfaces lying in vertical planes. Such a suspended structure is sometimes termed a vertical ceiling because of the vertical orientation of the major surfaces. These structures have an unusual and attractive decorative appearance, and also serve to conceal structures such as lights, sprinklers, speakers, cameras, ventilation equipment, etc., mounted in the space or plenum above the suspended structure, while permitting passage of illumination, water, sound or air between the panels.

BRIEF SUMMARY OF THE INVENTION

One or more embodiments of the suspended architectural structure of the present invention include a plurality of fin support members configured to couple with one or more architectural structures, e.g. ceiling structure. The fin support members are preferably in a modular frame configuration for ease of installation. The modular configuration allows for use of as many modules are needed to cover a room. In addition, modules of different configurations and sizes may be provided to adapt to the configuration of the room. For examples, the modules may be rectangular, triangular, circular, etc. in shape without deviating from the spirit of the invention.

In one or more embodiments, the modular frame comprises a rib frame. The rib frame is configured to hang from the ceiling structure. In a preferred embodiment, the modular frame comprises a rectangular rib frame with one or more lateral rib members positioned within the rib frame. The lateral rib members may be attached between side members of the rib frame, between a side member and a second lateral rib member, and between lateral rib members. The desired configuration of the lateral rib members depends on the final desired decorative appearance of the module.

Each rib member is preferably a u-shaped structural component. The preferred material is metal that can be welded to other metal component. Each side of the rib frame is preferably configured with one or more holes or orifices on the outside. The holes on each side provide for ease of coupling to a second rib frame. Coupling may be accomplished with one or more bolts and nuts. Thus, for a rectangular frame configuration, up to four other rib frames can be coupled to the one rib frame, i.e. one on each side.

One or more embodiments of the suspended architectural structure includes a plurality of flexible fins, with each flexible fin configured with one or more attachment points that is configured to be coupled to the plurality of fin support members. The attachment points may be configured as flaps or sleeves. The flexible fins are preferably coupled to the ribs at their attachment points using removable pins. Coupling could also be accomplished using other methods, e.g. clips, clamps, etc. inside the rib or below.

In one or more embodiments, the plurality of flexible fins comprises one or more primary fins and a plurality of secondary fins. In a preferred configuration, a primary fin is attached to the bottom of and runs substantially the full length of a lateral rib member. Each primary fin is preferably secured with a pin, with the pin located in the inside of the rib. However, the primary fin could also be coupled to the lateral rib using other methods without deviating from the spirit of the present invention.

In one or more embodiments, the secondary fins are coupled between a first side member and a second side member of the rib frame, a side member of the rib frame and a lateral member, and between a first lateral member and a second lateral member. Coupling of the secondary fin is preferably accomplished using pins inside the rib. However, the secondary fins could also be coupled using other methods, e.g. clips, clamps, etc. inside or outside the ribs. The secondary fins are preferable arranged in a decorative configuration below the rib frame.

Each rib member may be further configured with one or more rib fin positions for securing the fins. Each rib fin position may be configured as a fin slot or any configuration suitable for securing a fin. For instance, each rib fin position may be configured as a rectangular slot in the bottom of the rib through which a flap at the top of a fin fits. The flap may subsequently be secured by a pin or clip in the inside of the rib. Each rib fin position may also be configured with a clamp or similar device that secures the fin attachment point to the rib fin position.

In one or more embodiments, the modular rib frame of the suspended architectural structure of the present invention is coupled to the ceiling structure with screw rods. The screw rods are preferably configured to be modular so that couplers can be used as needed to achieve a desired height clearance from the floor.

In one or more embodiments, the modular rib frame of the suspended architectural structure of the present invention may also be coupled to the ceiling or other building structure with wires or strings. The wires or strings are configured to provide support for seismic or similar events that may cause the building to sway. The wires are preferably coupled at each corner of the modular rib frame.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

A suspended architectural structure will now be described. In the following exemplary description numerous specific details are set forth in order to provide a more thorough understanding of embodiments of the invention. It will be apparent, however, to one of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the systems and methods for a supported architectural design.

Figure 2:
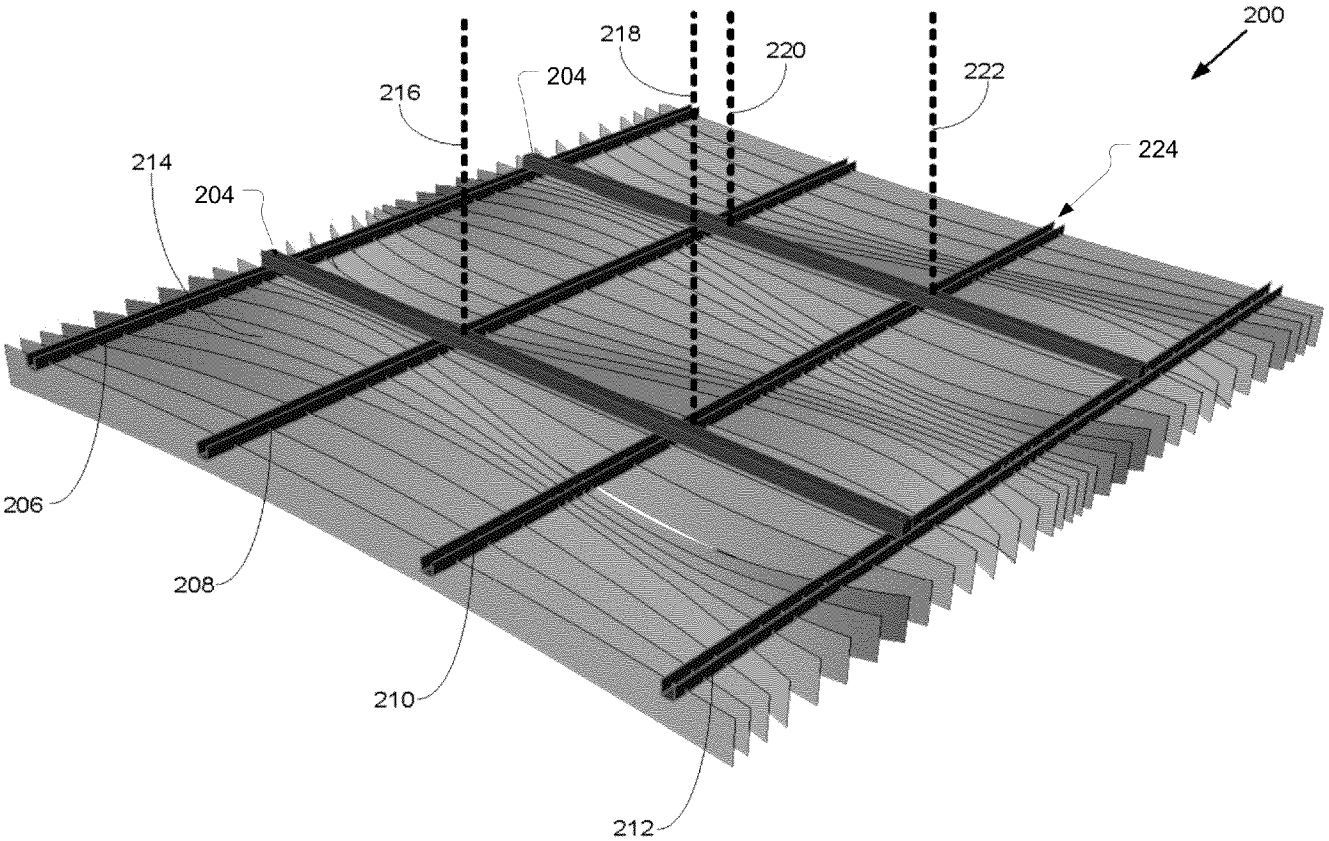
FIG. 2 is a top perspective view of an exemplary supported architectural structure in accordance with one or more embodiments of the present invention.

FIG. 2 is a top perspective view of an exemplary supported architectural design system in accordance with one or more embodiments of systems and methods for a supported architectural design. Supported architectural design system 200 includes a plurality of primary supports 202-204. In one or more embodiments, primary supports 202-204 are coplanar. In one or more embodiments, primary supports 202-204 are substantially parallel. Primary supports 202-204 may be constructed of any suitable material, such as plastic, wood, metal, composite, or any other material suitable for providing structural support.

Although two primary supports 202-204 are shown, one of ordinary skill in the art will recognize that any number of primary supports may be used without departing from the spirit or the scope of the embodiments described herein.

Primary supports 202-204 are configured to couple with one or more architectural structures. Primary supports 202-204 may couple with one or more architectural structures by one or more fasteners and/or structural components capable of supporting supported architectural design system 200, including but not limited to one or more cables, struts, beams, couplers, plates, joints, pipes, rails, or any other structural components capable of partially or fully supporting supported architectural design system 200. The one or more fasteners may include nuts, bolts, screws, clamps, pins, clips, sheet metal, hinges, rivets, lugs, caps, washers, nails, anchor, or any other fastener capable of coupling primary supports 202-204, one or more structural components, and one or more architectural structures. Primary supports 202-204 may be configured to couple with at least one wall system and/or structure. In one or more embodiments, primary supports 202-204 are configured to couple with one or more ceiling systems and/or structures.

Figure 1:
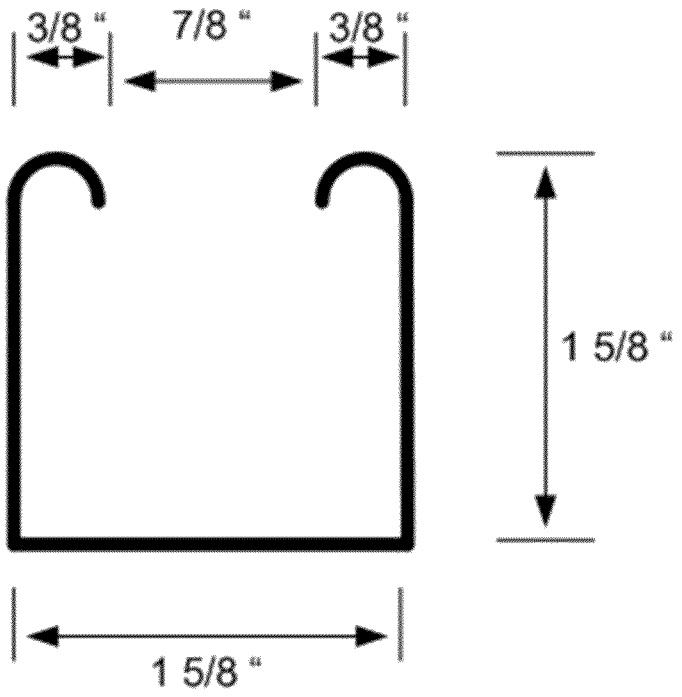
FIGURE 1 (Prior Art)
FIG. 1 is a cross sectional view of a primary or secondary support structure showing a standard strut channel.

In one or more embodiments, primary supports 202-204 include one or more strut channels 224 compatible with one or more standardized structural systems. A standard strut channel is illustrated in FIG. 1. As used herein, the term "standardized structural system" refers to any standardized structural system used in construction. In one or more embodiments, the strut channel is constructed out of a metal, such as aluminum, steel or any other metal suitable for use in construction for structural support. In one or more embodiments, the strut channel is formed from sheet metal folded over into an open channel shape with and inwards-folding lips that enhance structural support and provide a mounting surface for interconnecting components compatible with the standardized structural system. In one or more embodiments, the strut channel has a width and a height of 1⅝ inches. One or more embodiments of supported architectural design system 200 may further include one or more additional structural components compatible with the standardized structural system, as described more fully at FIG. 3.

In one or more embodiments, primary supports 202-204 include one or more P1000 Unistruts coupled to one or more hanger rods and/or cables using one or more Unistrut "U" shape fittings and one or more fasteners, such as one or more bolts and channel nuts. The one or more hanger rods and/or cables are configured to couple with one or more ceiling systems to suspend supported architectural design system 200. The one or more hanger rods and/or cables may be positioned along axes 216-222. In one or more embodiments, one or more Unistrut support components are configured to pass through the one or more Unistrut "U" shape fittings. Additional structural components compatible with the standardized structural system may be attached to the one or more Unistrut support components. A Unistrut "U" shape fitting may be provided for each quadrant of supported architectural design system 200.

Supported architectural design system 200 further includes a plurality of secondary supports 206-212. In one or more embodiments, secondary supports 206-212 are coplanar. In one or more embodiments, secondary supports 206-212 are substantially parallel.

Although secondary supports shown in FIG. 2 are straight, at least one of secondary supports 206-212 may be curved without departing from the spirit or the scope of the embodiments described herein. In one or more embodiments, at least one of outer secondary supports 206 and 212 is curved. As used herein, the term "curved" is used to describe a shape other than a straight line, including any shape that has a combination of straight, angular and arched segments. In one or more embodiments, when outer secondary supports 206 and 212 are curved, attachment points of flexible fins 214 are coupled to fin slots of outer secondary supports 206 and 212 in accordance with FIG. 6.

Secondary supports 206-212 may be constructed of any suitable material, such as plastic, wood, metal, composite, or any other material suitable for providing structural support. In one or more embodiments, secondary supports 206-212 are constructed out of a metal, such as steel, aluminum, or any other metal suitable for secondary supports 206-212.

Secondary supports 206-212 are configured to couple with primary supports 202-204. In one or more embodiments, secondary supports 206-212 are substantially perpendicular to primary supports 202-204 when coupled. Secondary supports 206-212 may be coupled with primary supports 202-204 with one or more fasteners, including but not limited to one or more may include nuts, bolts, screws, clamps, pins, clips, sheet metal, hinges, rivets, lugs, caps, washers, nails, anchor, or any other fastener capable of partially or fully coupling secondary supports 206-212 to primary supports 202-204. In one or more embodiments, secondary supports 206-212 are welded, manufactured, molded, glued, taped, or otherwise attached to primary supports 202-204 with or without one or more fasteners.

In one or more embodiments, secondary supports 206-212 are cold rolled steel channels. Although any gauge of metal may be used to form channels of any size, one or more embodiments of secondary supports 206-212 are 12 gauge cold rolled steel channels with a length and width of 1.5 inches. Secondary supports 206-212 may be coupled to primary supports 202-204 using one or more 12 gauge metal connectors welded to a secondary support in conjunction with one or more other fasteners passing through the 12 gauge metal connectors.

In one or more embodiments, a secondary support may be made of two or more separate components coupled together. The two or more separate components may be coupled together using one or more fasteners, adhesive, welding, or any other process capable of joining the two or more separate components to form a secondary support. In one or more embodiments, one or more of secondary supports 206-212 is composed of two or more separate 12 gauge cold rolled steel channels coupled using 12 gauge end plates welded to the channels and secured with one or more fasteners passing through the 12 gauge end plates.

Although four secondary supports 206-212 are shown, one of ordinary skill in the art will recognize that any number of secondary supports may be used without departing from the spirit or the scope of the embodiments described herein.

Figure 4:
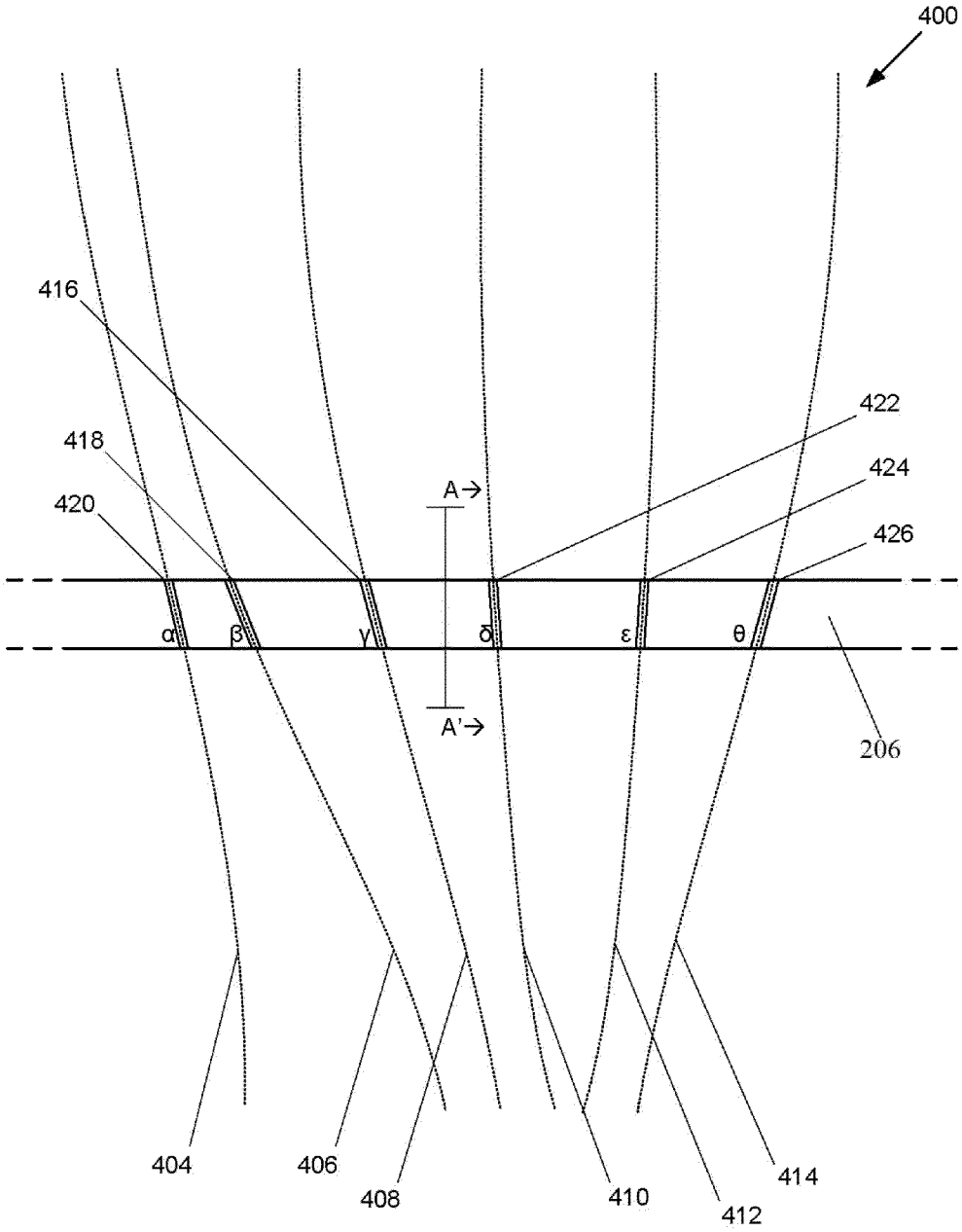
FIG. 4 illustrates an exemplary secondary support in accordance with one or more embodiments of the present invention.

Secondary supports 206-212 have a plurality of fin slots configured to couple with a plurality of flexible fins 214, as described more fully at FIG. 4.

Supported architectural design system 200 further includes a plurality of flexible fins 214. Flexible fins 214 are constructed out of any flexible material, such as steel, aluminum, any other metal, plastic, or any other flexible material capable of flexing to fit through the fin slots of secondary supports 206-212. In one or more embodiments, flexible fins 214 are be constructed from 22 gauge cold rolled steel. Flexible fins 214 may be veneered steel.

One or more embodiments also enable the use of rigid fins. Rigid fins may be constructed out of any material, such as steel, aluminum, any other metal, plastic, or any other suitable material.

In one or more embodiments, flexible fins 214 have an inner edge facing the plurality of secondary supports and an outer edge facing away from the plurality of secondary supports. The inner edge may include a plurality of attachment points configured to couple with secondary supports 206-212. The flexible fins 214 are configured to couple with secondary supports 206-212. The attachment points of flexible fins 214 may be configured to couple with the fin slots of secondary supports 206-212. In one or more embodiments, the flexible fins 214 are configured to protrude from secondary supports 206-212 when coupled with secondary supports 206-212. In one or more embodiments, a position of one or more attachment points of flexible fins 214 is customized based on a fin configuration design. Attachment points may be laser-cut using a laser-cutting device provided with the desired positions for the plurality of attachment points.

Figure 3:
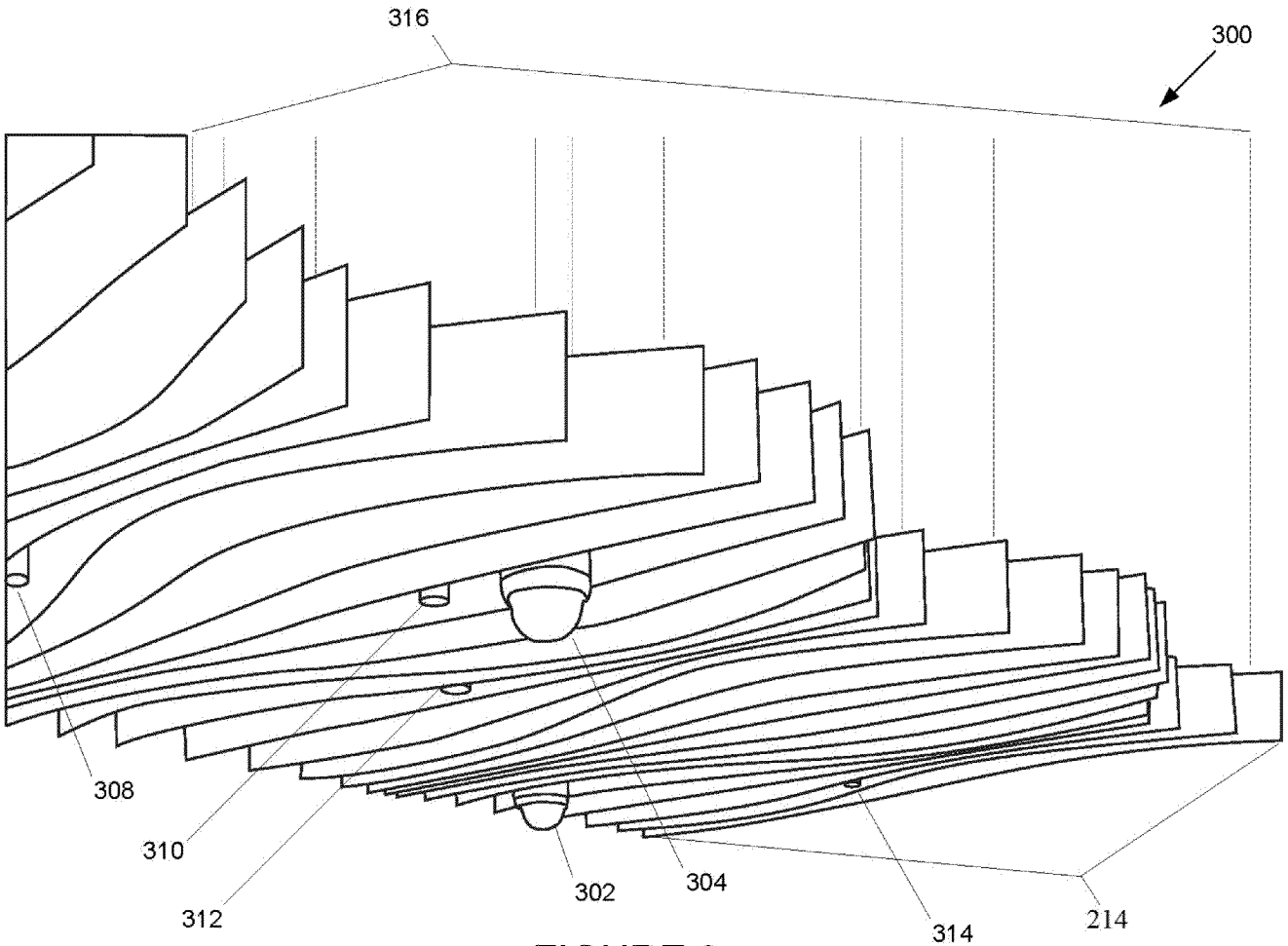
FIG. 3 is a bottom perspective view of an exemplary supported architectural structure in accordance with one or more embodiments of the present invention.

FIG. 3 is a bottom perspective view of an exemplary supported architectural design system in accordance with one or more embodiments of systems and methods for a supported architectural design. Supported architectural design system 300 is coupled with one or more architectural structures by supports 316. Supports 316 include one or more fasteners and/or structural components capable of supporting supported architectural design system 300, including but not limited to one or more cables, struts, beams, couplers, plates, joints, pipes, rails, or any other structural components capable of partially or fully supporting supported architectural design system 300. In one or more embodiments, supports 316 couple supported architectural design system 300 with one or more ceiling systems.

Supported architectural design system 300 may include one or more additional elements 302-312. Additional elements 302-312 may include lights, security cameras, decorative elements, or any other additional elements compatible with systems and methods for a supported architectural design. Additional elements 302-312 may be coupled with primary supports and/or or secondary supports of supported architectural design system 300. In one or more embodiments, additional elements 302-312 include at least one hanging element partially or fully extending beyond the outer edges of flexible fins 214 of supported architectural design system 300.

In one or more embodiments, the primary supports of supported architectural design system 300 include one or more strut channels compatible with one or more standardized structural systems. In one or more embodiments, additional elements 302-312 may be coupled with one or more additional structural components that are compatible with the standardized structural system. The additional structural components may include a lighting system 308, 310, 312, and 314, security system 302 and 304, a support system 316, or any other system compatible with the standardized structural system.

In one or more embodiments, the primary supports of supported architectural design system 300 are P1000 Unistruts and the additional structural components include Unistrut-compatible support components coupled with one or more additional elements 302-312. The P1000 Unistruts and the Unistrut-compatible support components are coupled using one or more fasteners, such as nuts, bolts, screws, clamps, pins, clips, sheet metal, hinges, rivets, lugs, caps, washers, nails, anchor, or any other fastener. In one or more embodiments, the fasteners include one or more Unistrut "U" shape fittings.

FIG. 4 illustrates an exemplary secondary support in accordance with one or more embodiments of systems and methods for a supported architectural design. Partial system 400 includes secondary support 206.

Secondary support 206 may be constructed of any suitable material, such as plastic, wood, metal, composite, or any other material suitable for providing structural support. In one or more embodiments, the secondary support 206 is constructed out of a metal, such as steel, aluminum, or any other suitable metal. In one or more embodiments, secondary support 206 is a cold rolled steel channel. Although any gauge of metal may be used to form a channel of any size, one or more embodiments of secondary support 206 is a 12 gauge cold rolled steel channel with a length and width of 1.5 inches.

Secondary support 206 has a plurality of fin slots 416-426 configured to couple with a plurality of flexible fins. Fin slots 416-426 are partial cuts made through the width of secondary support 206. In one or more embodiments where secondary support 206 is a channel, fin slots 416-426 may be any partial cut through the channel, such as a partial cut through a bottom wall of the channel, a complete cut through a bottom wall of the channel, a cut through the bottom wall of the channel and at least one side wall of the channel, or any other partial cut in secondary support 206. In one or more embodiments, the width of fin slots 416-426 is greater than a width of a flexible fin.

In one or more embodiments, fin slots 416-426 are custom cuts that are determined using a general-purpose computer with at least one processor configured to execute computer-readable instructions stored on a computer-readable medium. The instructions are configured to cause the at least one processor to perform steps including obtaining a fin configuration design including fin positions 404-414, determining a structurally sound configuration for a plurality of primary supports, and determining a structurally sound configuration for a plurality of secondary supports 206, and calculating a position and shape for a plurality of fin slots 416-426 based on fin positions 404-414. In one or more embodiments, one or more secondary supports 206 are custom-cut based on the calculated positions and shapes for the plurality of fin slots 416-426. Although any method of providing custom-cut fin slots 416-426 may be used, one or more embodiments of secondary support 206 are laser-cut using a laser-cutting device provided with the calculated positions and shapes for the plurality of fin slots 416-426.

Fin slots 416-426 are configured to guide flexible fins of a supported architectural design system along the desired fin positions 404-414. Fin slots 416-426 may be straight cuts in secondary support 206 made at angles $\alpha$ $\beta$ $\gamma$ $\delta$ $\epsilon$ and $\theta$. Angles $\alpha$ $\beta$ $\gamma$ $\delta$ $\epsilon$ and $\theta$ may include any angle determined based on fin positions 404-414, including a right angle directly across the width of secondary support 206. In one or more embodiments, fin slots 416-426 may include one or more curved cuts in secondary support 206.

Figure 5:
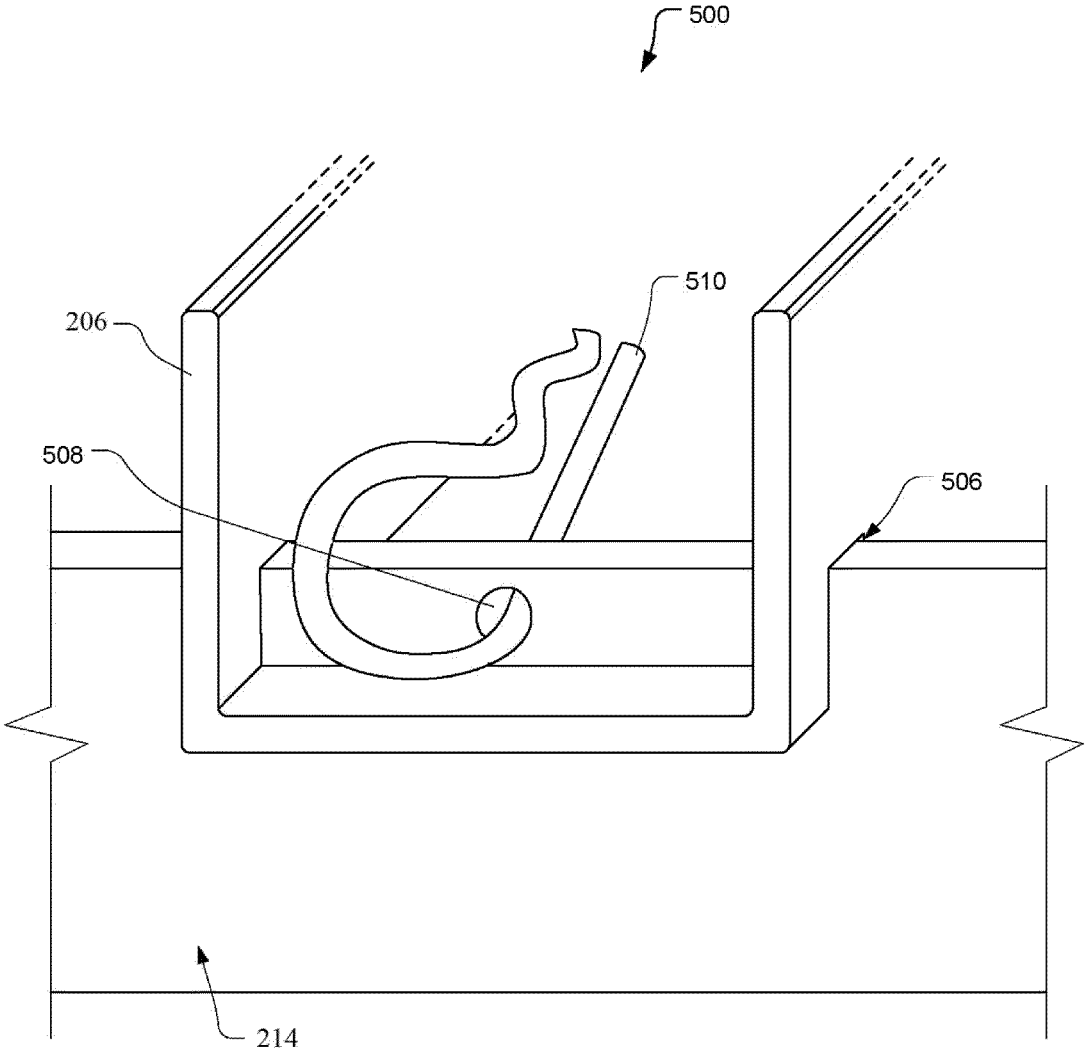
FIG. 5 is a cross sectional view of an exemplary secondary support configuration for coupling with a flexible fin in accordance with one or more embodiments of the present invention.

FIG. 5 is a cross sectional view (A-A' in FIG. 4) of an exemplary secondary support coupled with a flexible fin in accordance with one or more embodiments of systems and methods for a supported architectural design.

Partial system 500 includes secondary support 206. Secondary support 206 is configured to receive flexible fin 214. Flexible fin 214 includes an inner edge with attachment point 508. Attachment point 508 may include one or more features on or near the inner edge of flexible fin 214 usable to couple flexible fin 214 with secondary support 206 at fin slot 506. In one or more embodiments, attachment point 508 does not include feature, and is simply an identified location for applying one or more fasteners 510 to flexible fin 214. The one or more features may include one or more holes, slots, cuts, protrusions, recesses, or any other feature usable to couple flexible fin 214 with secondary support 206 at fin slot 506. The one or more features may be cut, manufactured, molded, glued, taped, welded, or otherwise applied to flexible fin 214 to provide attachment point 508.

In one or more embodiments, secondary support 206 is a channel and fin slot 506 is a cut through a portion of secondary support 206, including the bottom wall and the two side walls such that an entire inner edge of flexible fin 214 may be seated within fin slot 506.

Attachment point 508 may be one or more holes near the inner edge of flexible fin 214. In one or more embodiments, attachment point 508 is configured to receive one or more fasteners 510 to couple flexible fin 214 with secondary support 206 when flexible fin 214 is seated within fin slot 506. In one or more embodiments, fasteners 510 may include one or more nuts, bolts, screws, clamps, pins, clips, sheet metal, hinges, rivets, lugs, caps, washers, nails, anchor, or any other fastener capable of coupling flexible fin 214 with attachment point 508 when flexible fin 214 is seated within fin slot 506.

In one or more embodiments, fasteners 510 may be welded, manufactured, glued, clamped or otherwise affixed to secondary support 206. In one or more embodiments, when flexible fin 214 is seated within fin slot 506, fastener 510 affixed to secondary support 206 are configured to automatically engage at least one attachment point 508 to couple flexible fin 214 with secondary support 206.

Figure 6:
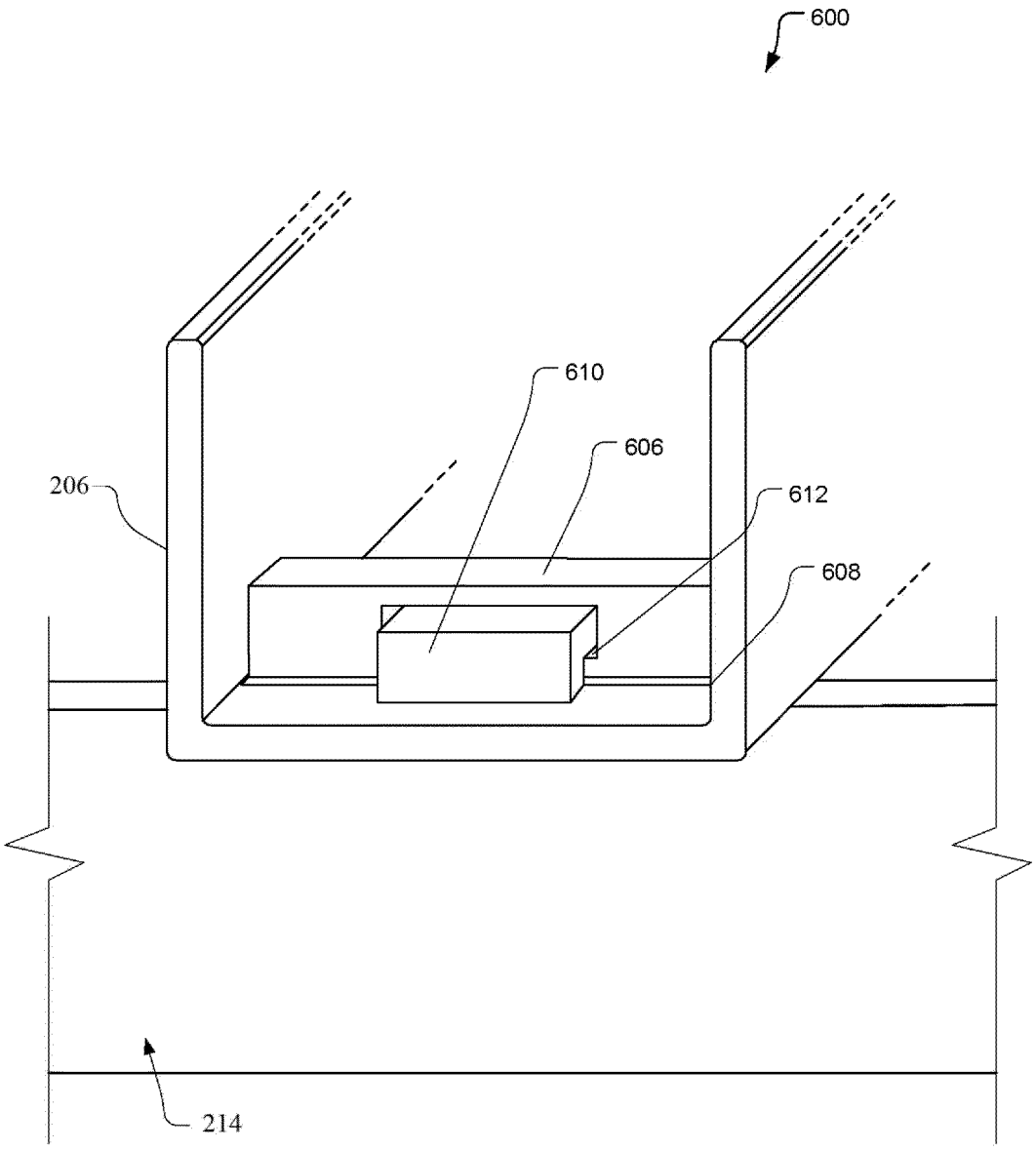
FIG. 6 is a cross sectional view of another exemplary secondary support configuration for coupling with a flexible fin in accordance with one or more embodiments of the present invention.

FIG. 6 is a cross sectional view (A-A' in FIG. 4) of an exemplary secondary support coupled with a flexible fin in accordance with one or more embodiments of systems and methods for a supported architectural design.

Partial system 600 includes secondary support 206. Secondary support 206 is configured to receive flexible fin 214. Flexible fin 214 includes an inner edge with one or more attachment points, including one or more features on or near the inner edge of flexible fin 214 usable to couple flexible fin 214 with secondary support 206 at fin slot 608. The one or more features may include one or more holes, slots, cuts, protrusions, recesses, or any other feature usable to couple flexible fin 214 with secondary support 206 at fin slot 608. The one or more features may be cut, manufactured, molded, glued, taped, welded, or otherwise applied to flexible fin 214 to provide attachment point 606.

In one or more embodiments, secondary support 206 is a channel and fin slot 608 is a cut through a bottom wall of secondary support 206 such that a protruding tab of flexible fin 214 may be seated within fin slot 612.

In one or more embodiments, the attachment point includes protruding tab 606 and slot 612. Protruding tab 606 protrudes from an inner edge of flexible fin 214. Protruding tab 606 is configured to fit within fin slot 608. Fin slot 612 is positioned on protruding tab 606. Fin slot 612 is configured to receive one or more fasteners 610 to couple flexible fin 214 with secondary support 206 when flexible fin 214 is seated within fin slot 612. In one or more embodiments, fasteners 610 may include one or more nuts, bolts, screws, clamps, pins, clips, sheet metal, hinges, rivets, lugs, caps, washers, nails, anchor, or any other fastener capable of coupling flexible fin 214 with fin slot 612 when flexible fin 214 is seated within fin slot 612.

In one or more embodiments, fasteners 610 may be welded, manufactured, glued, inserted, clamped or otherwise affixed to secondary support 206. In one or more embodiments, when protruding tab 606 is inserted into fin slot 608, fastener 610 automatically engages slot 612 to couple flexible fin 214 with secondary support 206.

Figure 7A:
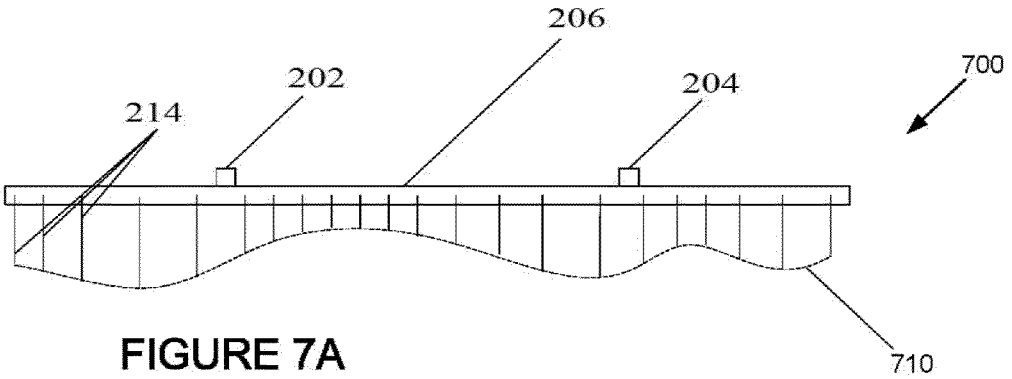
FIGS. 7A-C illustrate exemplary supported architectural structure in accordance with one or more embodiments of the present invention.
Figure 7B:
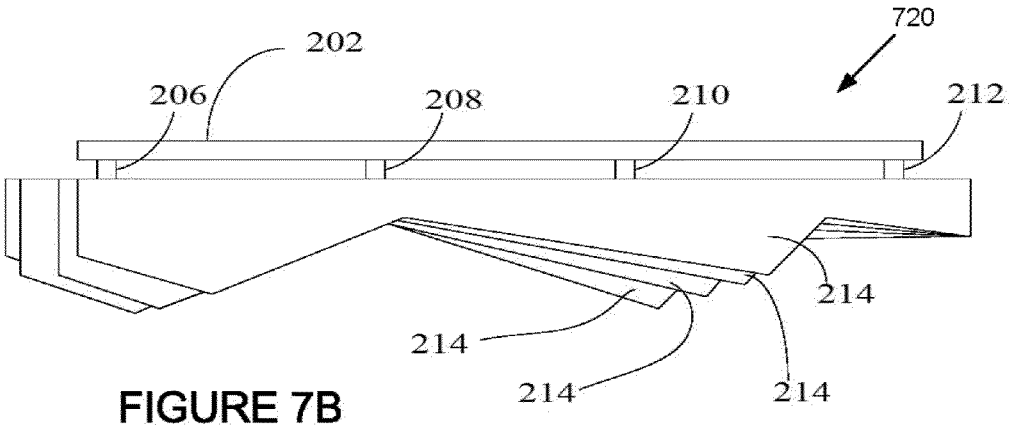
Figure 7C:
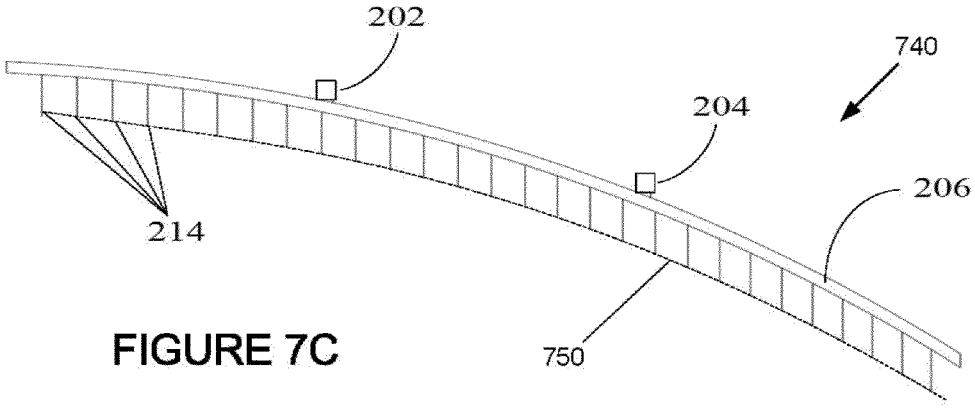

FIGS. 7A-C illustrate exemplary supported architectural design systems in accordance with one or more embodiments of systems and methods for a supported architectural design.

FIG. 7A is a side view of an exemplary supported architectural design system in accordance with one or more embodiments of systems and methods for a supported architectural design. Supported architectural design system 700 includes a plurality of primary supports 202-204 coupled with a plurality of secondary supports 206. A plurality of flexible fins 214 are coupled with a plurality of secondary supports 206. An outer edge of flexible fins 214 conforms to a curved two-dimensional surface 710. In one or more embodiments, curved two-dimensional surface 710 includes any surface in three-dimensional space. As used herein, the term "curved two-dimensional surface" includes any surface in three-dimensional space, including one or more flat surfaces, angled surfaces, rounded or arched surfaces, or any combination thereof. The curve two-dimensional surface may include curved portions, flat portions, angled portions, or any combination thereof.

FIG. 7B is a side view of an exemplary supported architectural design system in accordance with one or more embodiments of systems and methods for a supported architectural design. Supported architectural design system 720 includes a plurality of primary supports 202 coupled with a plurality of secondary supports 206, 208, 210, and 212. A plurality of flexible fins 214 is coupled with secondary supports 206-212 and outer edge of flexible fins 214 conforms to a curved two dimensional surface, such as a curved surface in three-dimensional space. The curve two-dimensional surface may include curved portions, flat portions, angled portions, or any combination thereof.

FIG. 7C is a side view of an exemplary supported architectural design system in accordance with one or more embodiments of systems and methods for a supported architectural design. Supported architectural design system 740 includes a plurality of primary supports 202 and 204 coupled with a plurality of secondary supports 206. A plurality of flexible fins 214 are coupled with secondary supports 206. An outer edge of flexible fins 214 conforms to a curved two-dimensional surface 750. In one or more embodiments, secondary supports 206 have a curvature in the elevation dimension as shown in FIG. 7C.

One or more embodiments of the suspended architectural structure of the present invention will now be described in detail with reference to FIGS. 8 through 14.

Figure 8:
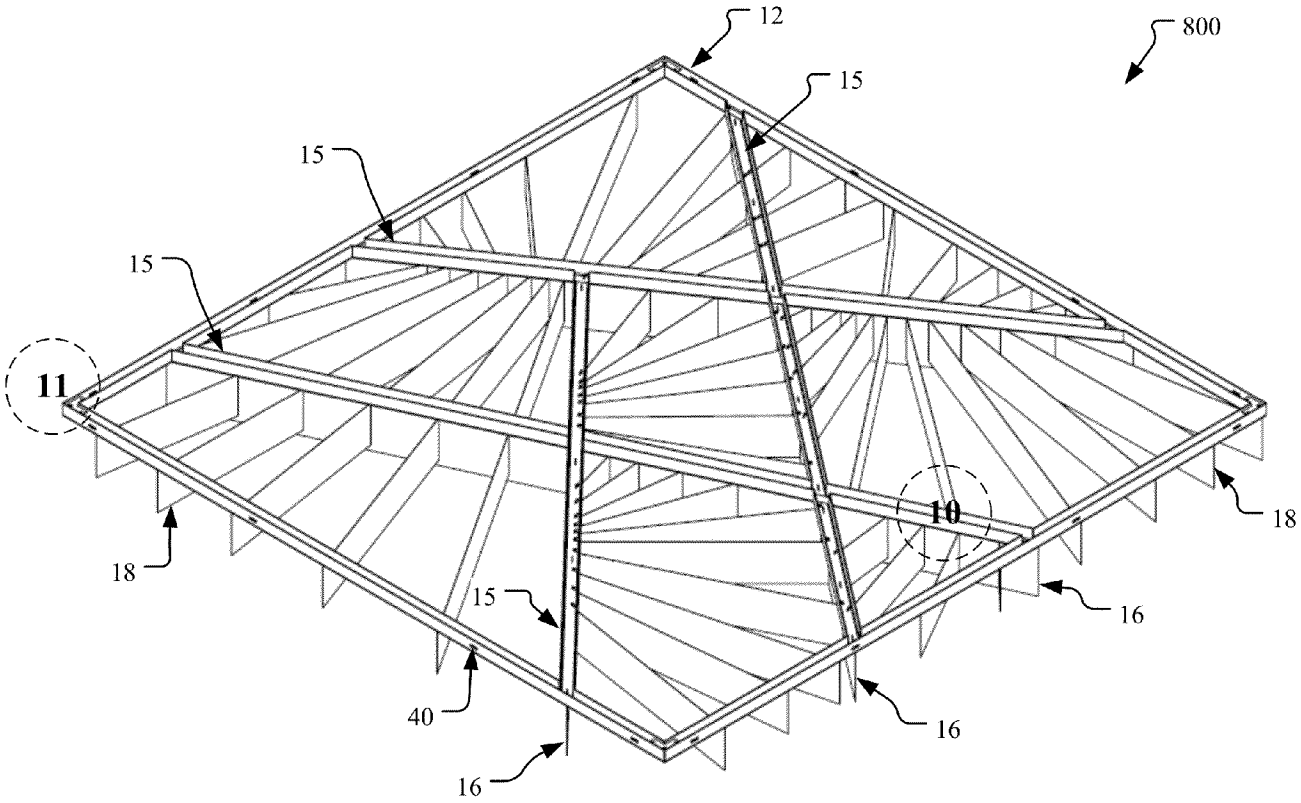
FIG. 8 is a top perspective view of an exemplary rib frame of a suspended architectural structure in accordance with one or more embodiments of the present invention.

FIG. 8 is a top perspective view of an exemplary rib frame of a suspended architectural structure in accordance with one or more embodiments of the present invention. As illustrated, the suspended architectural structure 800 comprises a frame 12. Frame 12 is preferably rectangular, but can take any desired shape to suite the room wherein the suspended architectural structure would be installed. Frame 12 is the outer frame of the suspended architectural structure and each side is preferably a rib with a u-shaped cross-section. Frame 12 is preferably constructed of metal; however, any structurally stiff material may be used without deviating from the spirit of the invention.

Frame 12 further includes one or more coupling orifices 40 on the outside wall, which is configured for coupling two frames 12 together. Thus, suspended architectural structure 800 may be configured in a modular configuration such that a plurality of modules 800 may be used, when needed, to cover the ceiling surface of a room. Modular configuration may be particularly advantageous, e.g. for ease of installation, when the target room is large.

Figure 9:
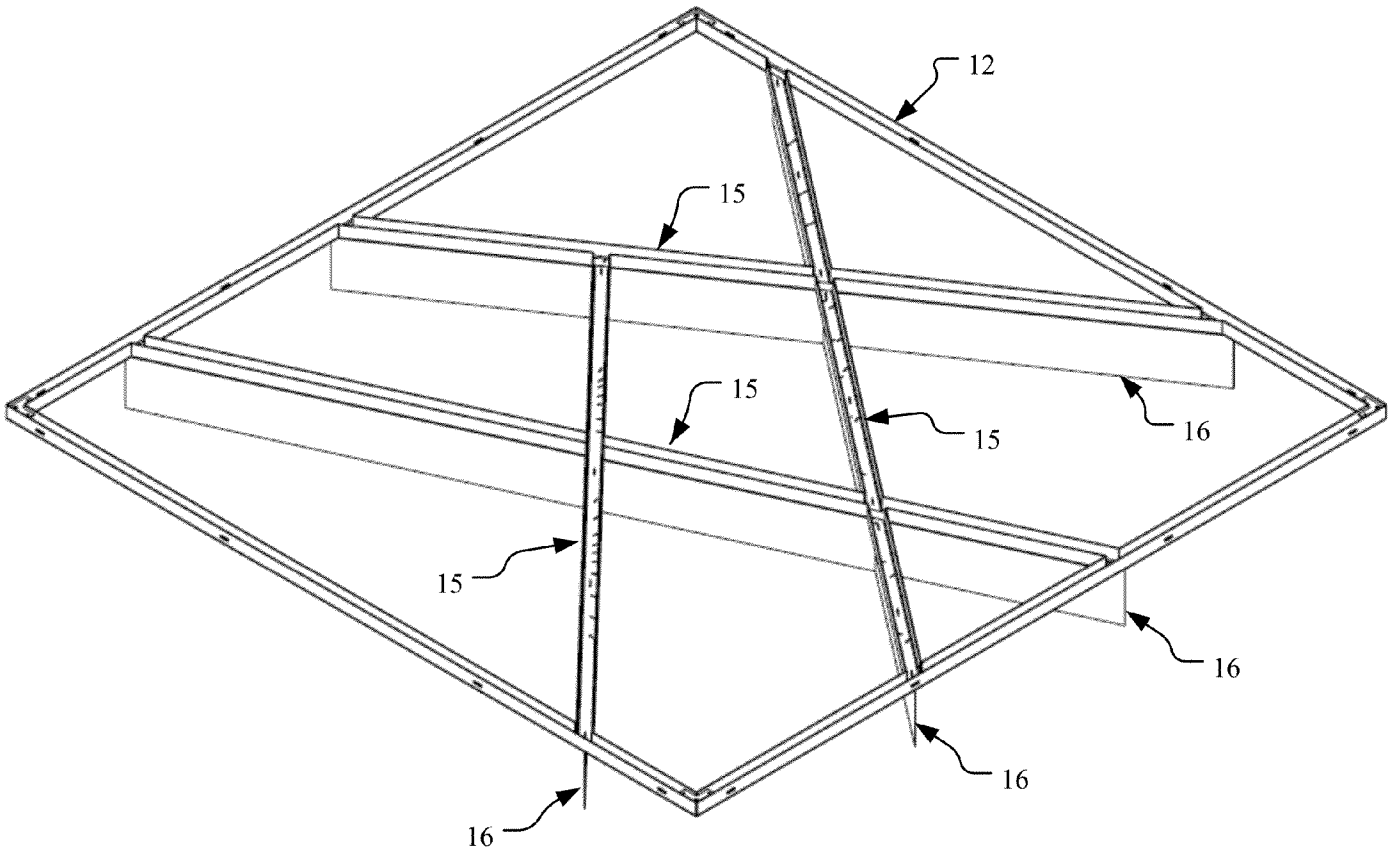
FIG. 9 is a top perspective view of the suspended architectural structure of FIG. 8 without the secondary fins in accordance with one or more embodiments of the present invention.

Suspended architectural structure 800 further includes one or more lateral ribs 15 coupled inside of frame 12, as further illustrated in FIG. 9. Each lateral rib 15 may be coupled between any two sides of frame 12, between one side of frame 12 and a second lateral rib member, or between lateral rib members. Lateral rib 15 is preferably a rib with a u-shaped cross-section. Lateral rib 15 is preferably constructed of metal; however, any structurally stiff material may be used without deviating from the spirit of the invention.

Suspended architectural structure 800 further includes one or more primary fins 16, with each primary fin 16 preferably coupled lengthwise (i.e. longitudinally) along the bottom side of each lateral rib member 15. Each primary fin 16 may run the entire length of the lateral rib 15 or a portion thereof. Those of skill in the art would appreciate that one or more of the lateral rib members may be configured without a primary fin coupled to it lengthwise without deviating from the spirit of the invention.

Figure 10:
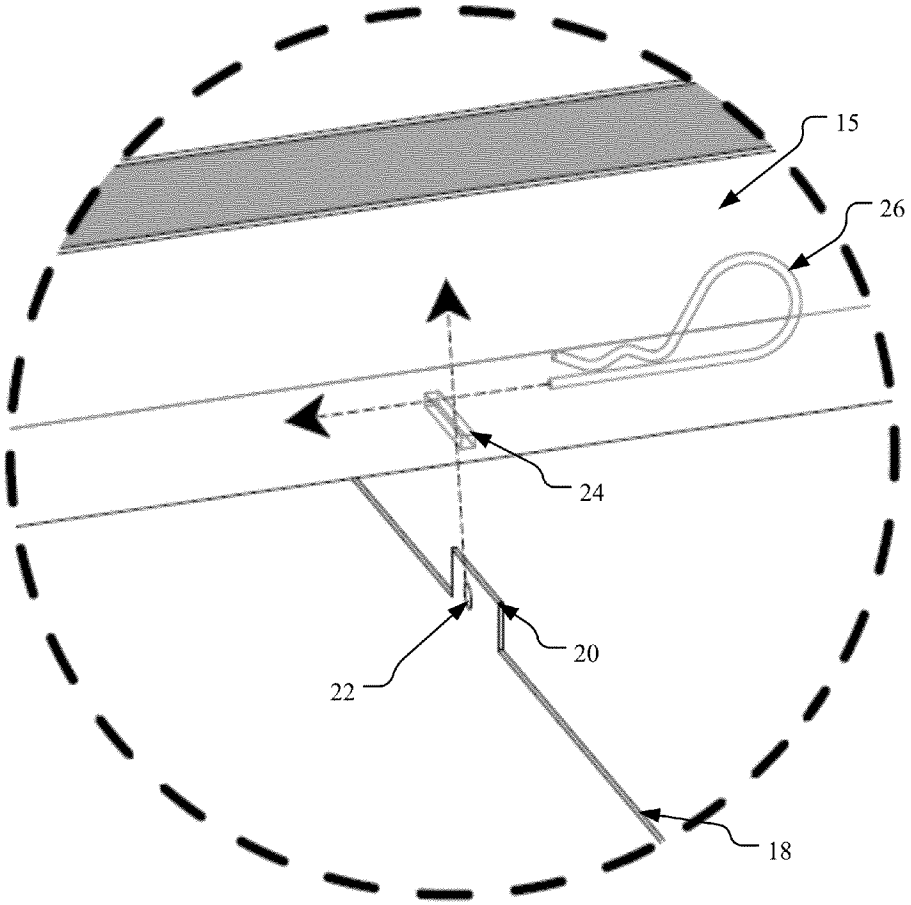
FIG. 10 is an illustration of the coupling of a secondary fin to a rib of the suspended architectural structure of FIG. 8 in accordance with one or more embodiments of the present invention.

As illustrated in FIG. 10, each primary fin 16 includes a flap (e.g. 20) at an attachment point. Each flap 20 preferably includes an orifice 22 for securing pin 26. Each primary fin 16 may include a plurality of attachment points. As illustrated, flap 20 fits through fin slot 24 so that pin 26 secures the primary fin 16 to the lateral rib 15 via the inside surface of the rib structure, i.e. pin 26 is inside of the u-shape rib. Fin slot 24 is preferably configured large enough to fit flap 20 and with its longitudinal direction dependent on the desired direction of the primary fin. For instance, for primary fins, the longitudinal direction (i.e. angle) of the fin slot 24 should conform to the longitudinal direction of the lateral rib 15. In this configuration, pin 26 secures flap 20 across the rib, i.e. side to side.

Suspended architectural structure 800 further includes one or more secondary fins 18. Each secondary fin 18 is preferably coupled between two or more ribs. For instance, a secondary fin 18 may be coupled between a side member of frame 12 and a lateral rib 15, between any two lateral ribs 15, or between two side members of frame 12. The secondary fins are preferably configured in a decorative manner and coupled to the bottom surface of the ribs.

Each secondary fin 18 includes a flap 20 at the attachment point (see FIG. 10). Each flap 20 preferably includes an orifice 22 for securing pin 26. Each secondary fin 18 may include a plurality of attachment points. For instance, if a secondary fin only couples between two rib members, e.g. lateral rib members 15, then the secondary fin may only require two attachment points, i.e. one at each end. As illustrated, flap 20 fits through fin slot 24 so that pin 26 secures the secondary fin 18 to the rib, e.g. 12 or 15, via the inside surface of the rib structure, i.e. pin 26 is inside of the u-shape rib. Fin slot 24 is preferably configured large enough to fit flap 20 and with its longitudinal direction dependent on the desired direction of the secondary fin.

Figure 11:
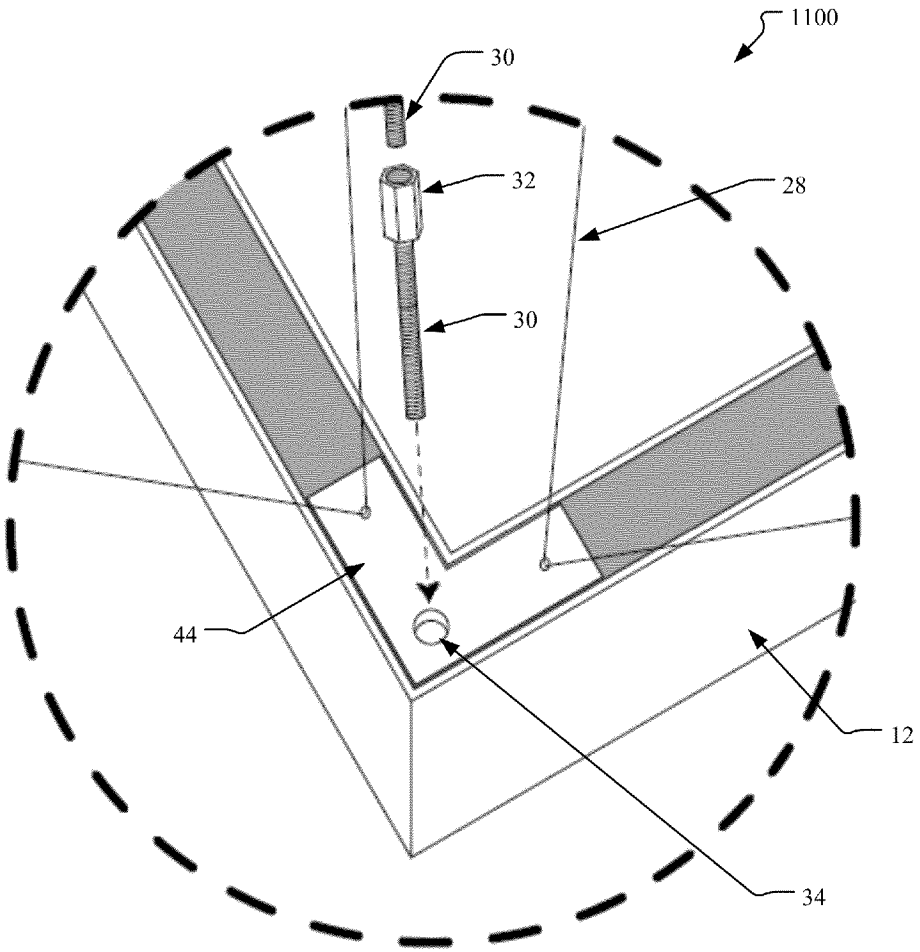
FIG. 11 is an illustration of the coupling of the suspended architectural structure of FIG. 8 to a ceiling structure in accordance with one or more embodiments of the present invention.

FIG. 11 is an illustration of the coupling of the suspended architectural structure of FIG. 8 to a ceiling structure in accordance with one or more embodiments of the present invention. As illustrated, suspended architectural structure 800 may be coupled (i.e. suspended) to the ceiling structure via threaded rod 30 at each corner 1100. An L-Shaped plate 44 may be provided and secured to the corner 1100 of the rib frame 12. Plate 44 may be secured by welding or any other means to corner 1100 of frame 12. Plate 44 may include hole 34 for securing threaded rod 30 to suspended architectural structure 800. Hole 34 may be threaded so that threaded rod 30 may be secured to plate 44 by screwing thereon. Hole 34 may also be unthreaded so that rod 30 is secured to plate 44 using a nut (not shown). A plurality of threaded rods 30 may be used, depending on the desired ground clearance, e.g. by coupling two rods together with coupling nut 32. The suspended architectural structure 800 may be further secured to a primary structure (e.g. ceiling structure) with wire (or string) 28 for safety during seismic or similar events (e.g. earthquake) that may cause the building to sway. Wire 28 is preferably secured at one end to plate 44 and at the other end to the ceiling or other structure of the building. A plurality of wire 28 may be used at each corner 1100.

Figure 12:
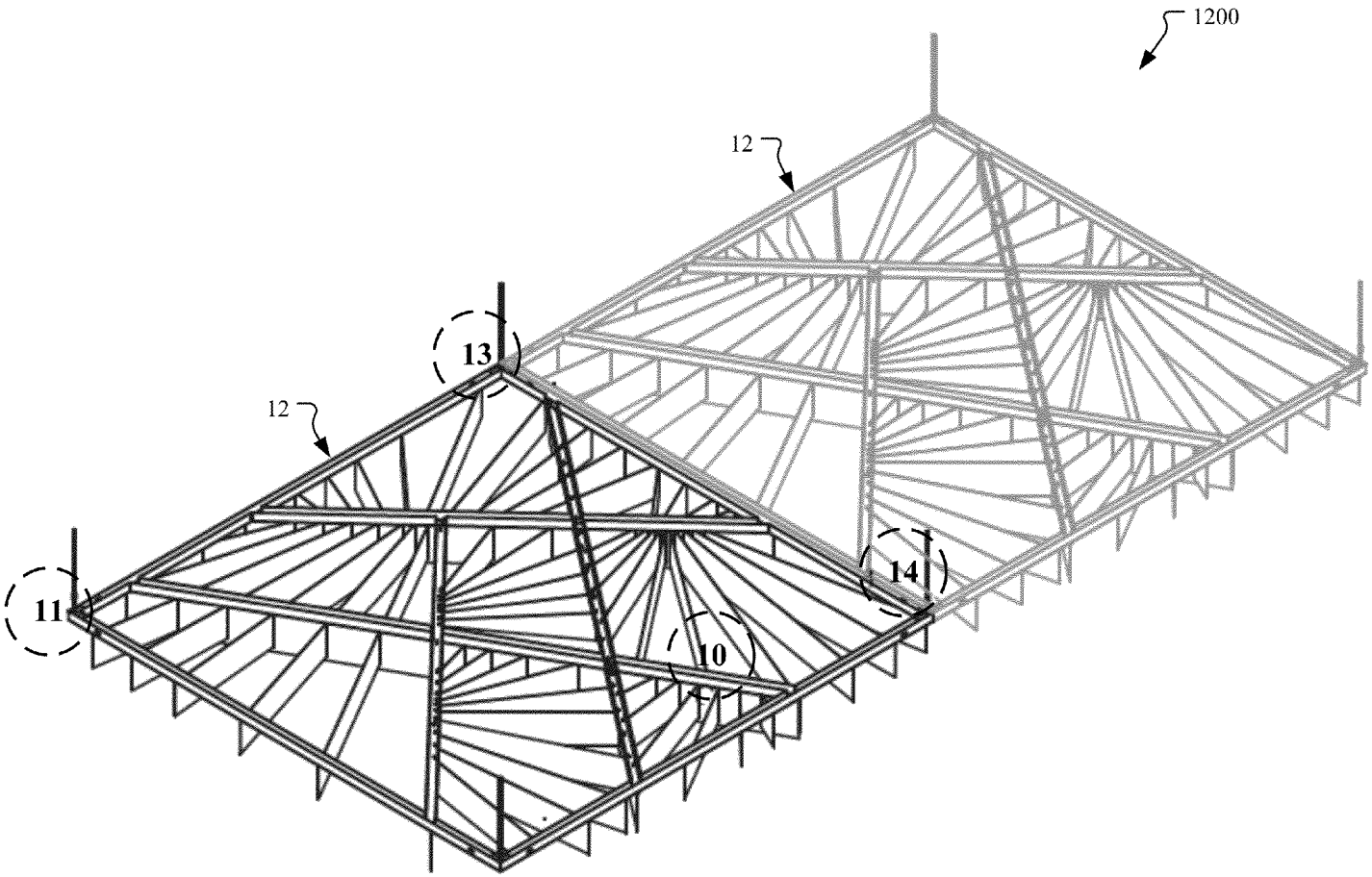
FIG. 12 is a top perspective view of the suspended architectural structure of FIG. 8 in a multiple rib frame installation configuration in accordance with one or more embodiments of the present invention.

FIG. 12 is a top perspective view of the suspended architectural structure of FIG. 8 in a multiple rib frame configuration in accordance with one or more embodiments of the present invention. As illustrated, multiple suspended architectural structures 800 may be coupled together to provide coverage for a room. In this configuration, two or more suspended architectural structures 800 are coupled as illustrated in FIG. 13 and FIG. 14.

Figure 13:
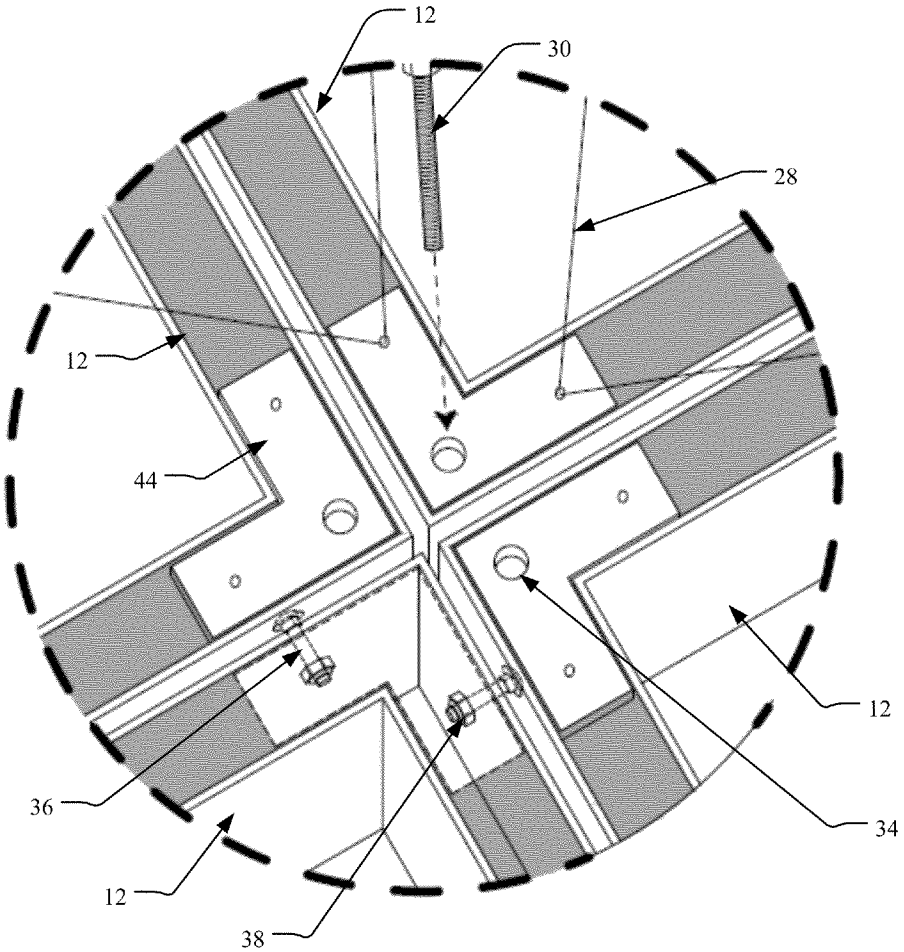
FIG. 13 is an illustration of the corner coupling of multiple suspended architectural structures of FIG. 8 in accordance with one or more embodiments of the present invention.

FIG. 13 is an illustration of the corner coupling of multiple suspended architectural structures in accordance with one or more embodiments of the present invention. As illustrated, the corners of four suspended architectural structures 800 may be coupled together using a plurality of nuts 38 and bolts 36 at orifice 40 located at the corner of each frame 12 such that each side corner of a frame 12 is coupled to a side corner of a second frame 12. In this configuration, only one member of suspended architectural structure 800 need be secured with threaded rod 30 and string/wire 28. Those of skill in the art would appreciate that more than one member of the multiple structure could be secured with the threaded rod and string without deviating from the spirit of the invention.

Figure 14:
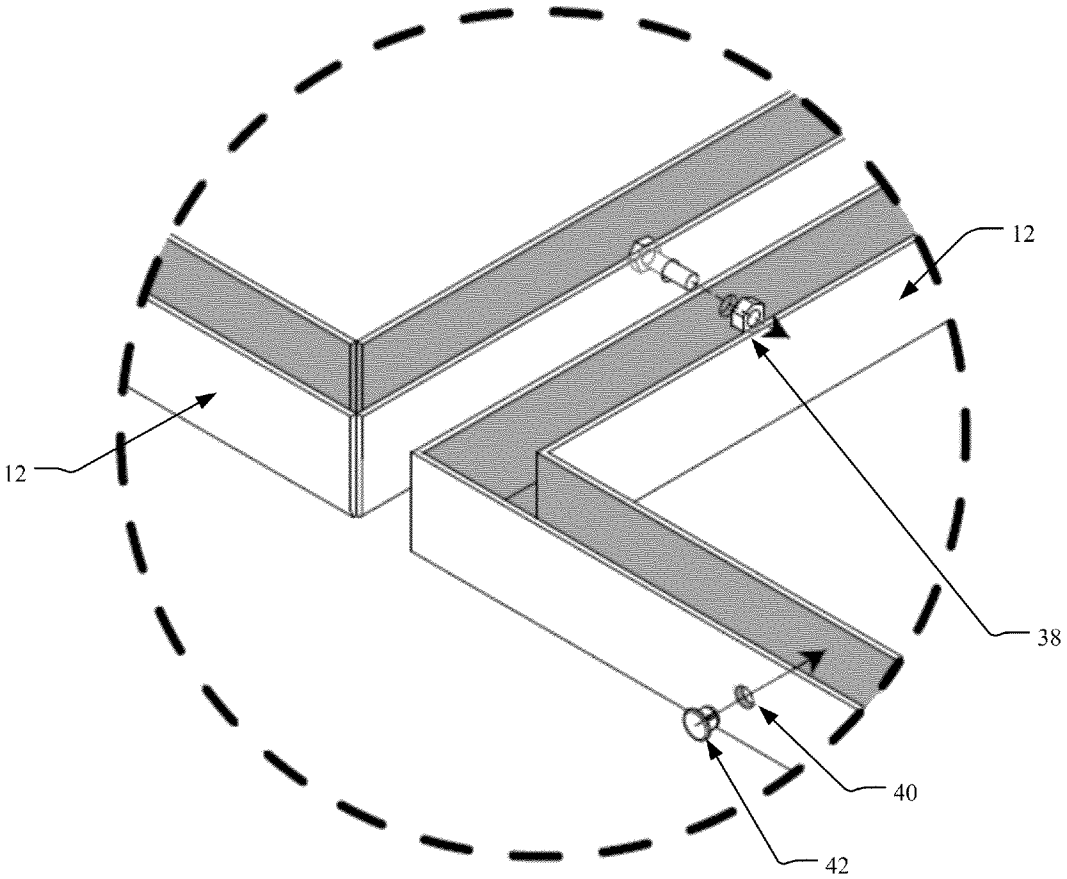
FIG. 14 is an illustration of the side coupling of two suspended architectural structures of FIG. 8 in accordance with one or more embodiments of the present invention.

FIG. 14 is an illustration of the side coupling of two suspended architectural structures 800 in accordance with one or more embodiments of the present invention. As illustrated, two members of the group may be additionally coupled together on opposing sides using nut 38 and bolt 36 at side orifice 40. Any unused orifice 40 may be plugged with cap 42 for aesthetic presentation.

While the systems and methods for providing a supported architectural design described herein disclosed has been described by means of specific embodiments and applications thereof, numerous modifications and variations could be made thereto by those skilled in the art without departing from the scope of the embodiments described herein set forth in the claims.

What is claimed is:

1. A suspended architectural structure comprising:

a plurality of fins, wherein each one of said plurality of fins includes a plurality of attachment points;

a rib frame configured to couple with a primary support structure, wherein said rib frame includes a plurality of fin slots, wherein said plurality of fins comprises one or more primary fins and a plurality of secondary fins, wherein said plurality of attachment points is coupled to said plurality of fin slots with one or more fasteners, wherein said rib frame is configured as a u-shaped channel, and wherein at least one of said plurality of fin slots comprises an orifice in a bottom wall of said u-shaped channel; and one or more lateral rib members coupled to said rib frame, wherein each one of said one or more lateral rib members includes a second plurality of fin slots, wherein said plurality of attachment points is coupled to said second plurality of fin slots with one or more fasteners, wherein each one of said one or more lateral rib members is configured as a u-shaped channel, and wherein at least one of said second plurality of fin slots comprises an orifice in a bottom wall of said u-shaped channel of said one or more lateral rib members, wherein each one of said one or more primary fins is coupled longitudinally to one of said one or more lateral rib members, wherein said plurality of secondary fins is substantially fanned across said one or more primary fins in a decorative manner.

2. The suspended architectural structure of claim 1, wherein said primary support structure is a ceiling structure of a room.

3. The suspended architectural structure of claim 1, wherein said rib frame is rectangular in configuration.

4. The suspended architectural structure of claim 3, wherein said rectangular rib frame is configured on each side to be coupleable to a second rib frame.

5. The suspended architectural structure of claim 1, wherein said rib frame and said one or more lateral rib members are arranged in a coplanar configuration.

6. The suspended architectural structure of claim 1, wherein each of said plurality of attachment points includes a pin hole, and wherein each of said one or more fasteners is a removable pin.

7. The suspended architectural structure of claim 1, wherein one of said plurality of fins is flexible.

8. A suspended architectural structure comprising:

a rib frame configured to couple with a primary support structure;

one or more lateral rib members coupled to said rib frame, wherein said one or more lateral rib members are located inside said rib frame, wherein said rib frame and said one or more lateral rib members are configured with a plurality rib fin positions; and a plurality of fins, wherein said plurality of fins comprises a plurality of primary fins and a plurality of secondary fins, wherein each one of said plurality of primary fins is coupled longitudinally to one of said one or more lateral rib members, wherein said plurality of secondary fins is substantially fanned across said plurality of primary fins in a decorative manner, wherein each one of said plurality of fins comprises a plurality of attachment points, and wherein each of said plurality of attachment points comprises a flap removably secured to one of said plurality of rib fin positions, wherein said rib frame and said one or more lateral rib members are u-shaped in cross-section, and wherein each of said plurality of rib fin positions is a slot configured to fit said flap.

9. The suspended architectural structure of claim 8, wherein said primary support structure is a ceiling structure of a room.

10. The suspended architectural structure of claim 8, wherein said flap includes a pinhole, and said flap is removably secured to one of said plurality of rib fin positions with a pin through said pinhole.

11. The suspended architectural structure of claim 8, wherein one of said plurality of fins is flexible.

12. A suspended architectural structure comprising:

a plurality of coplanar fin support members coupled to a primary support structure, each one of said plurality of fin support members including a plurality of fin slots;

a plurality of fins, each one of said plurality of fins having one or more attachment points, each attachment point configured to couple to one of said plurality of fin slots, and wherein each of said plurality of one or more attachment points comprises a flap configured to receive a fastener, wherein each fastener secures said flap to one of said plurality of fin slots, wherein one or more fasteners removably coupling each one of said plurality of fins to at least one or more of said plurality of fin support members at said one or more attachment points, wherein said plurality of fins comprises a plurality of primary fins and a plurality of secondary fins, wherein said plurality of fin support members comprises an outer rib frame and a plurality of lateral rib members coupled to said outer rib frame, wherein each one of said plurality of primary fins is coupled longitudinally to one of said plurality of lateral rib members, wherein said plurality of secondary fins is substantially fanned across said plurality of primary fins in a decorative manner.

13. The suspended architectural structure of claim 12, wherein said primary support structure is a ceiling structure of a room.

14. The suspended architectural structure of claim 12, wherein one of said plurality of fins is flexible.

* * * * *